United States Patent [19]

Watanabe et al.

[11] Patent Number: 4,881,067

[45] Date of Patent: Nov. 14, 1989

[54] IMAGE FORMING APPARATUS AND METHOD

[75] Inventors: Osamu Watanabe, Tokyo; Kosuke Komatsu, Kanagawa; Masaichi Ishibashi, Saitama; Mutsumi Kimura, Tokyo; Shinsuke Koyama, Tokyo; Takahiro Fujimori, Tokyo; Tadashi Fujiwara, Tokyo; Junko Kuroiwa, Kanagawa, all of Japan

[73] Assignee: Sony Corporation, Tokyo, Japan

[21] Appl. No.: 801,826

[22] Filed: Nov. 26, 1985

[30] Foreign Application Priority Data

Nov. 30, 1984 [JP] Japan ..... 59-253659

[51] Int. Cl.[4] ..... G09G 1/14

[52] U.S. Cl. ..... 340/750; 364/518

[58] Field of Search ..... 358/142, 12, 146, 147; 340/723, 724, 726, 747, 750; 364/518, 521

[56] References Cited

U.S. PATENT DOCUMENTS

| | | | |
|---|---|---|---|
| 4,132,701 | 5/1979 | Louie | 364/200 |
| 4,249,172 | 2/1981 | Watkins et al. | 340/726 |
| 4,342,029 | 7/1982 | Hofmanis et al. | 340/747 |
| 4,439,761 | 3/1984 | Fleming et al. | 358/147 |
| 4,646,134 | 2/1987 | Komatsu et al. | 358/11 |
| 4,700,182 | 10/1987 | Ohgami | 340/750 |

FOREIGN PATENT DOCUMENTS

| | | | |
|---|---|---|---|
| 8402821 | 7/1984 | France | 358/12 |

*Primary Examiner*—James J. Groody
*Assistant Examiner*—David E. Harvey
*Attorney, Agent, or Firm*—Lewis H. Eslinger; Jay Maioli; Donald S. Dowden

[57] ABSTRACT

In changing or otherwise handling sequential videotex codes composed of geometric codes representing individual image areas as respective geometric drawings and also characteristic codes representing attributes of the geometric drawings, the order of transmission of the geometric codes and characteristic codes is supervised on an order table and a characteristic code table is provided for supervising the characteristic codes, with correction or rearranging of the videotex code data being effected on these tables. In the case where the videotex codes are to represent an input color image, a histogram of the frequencies of occurrence of all colors represented by color data for each input color image is produced and a predetermined relatively small number n of colors having the highest frequencies of occurrence, either in the histogram as a whole, or in divisions of the histogram, are selected and each image area has assigned thereto color data representing the one of the n selected colors closest to the actual color of the image area in question.

12 Claims, 14 Drawing Sheets

105

| ORDER (105A) | GEOMETRIC CODE (105B) | CHARACTERISTIC CODE DATA POINTER (105C) | DATA POINTER (105D) | VARIOUS FLAGS |
|---|---|---|---|---|
| 1 | RECTANGLE | 1 | 2 | |
| 2 | ARC | 6 | 1 | |
| 3 | LINE | 1 | 5 | |
| 4 | PLYGON | 12 | 19 | |
| 5 | POINT | 4 | 3 | |
| | | | | |
| | | | | |
| ℓ | RECTANGLE | 36 | | |

FIG. 8(A)

105

| ORDER | GEOMETRIC CODE (105A) | CHARACTERISTIC CODE DATA POINTER (105B) | DATA POINTER (105C) | VARIOUS FLAGS (105D) |
|---|---|---|---|---|
| 1 | RECTANGLE | 1 | 2 | |
| 2 | ARC | 6 | 1 | |
| 3 | LINE | 1 | 5 | |
| 4 | PLYGON | 12 | 19 | |
| 5 | POINT | 4 | 3 | |
| | | | | |
| ℓ | RECTANGLE | 36 | | |

FIG. 8(B)

106

| ENTRY NUMBER (106A) | PEL SIZE (106B) | COLOR (106B) | TEXTURE (106C) |
|---|---|---|---|
| 1 | 3 | RED | HORIZONTAL LINE |
| 2 | 2 | WHITE | |
| | | | |
| | | | |
| n | 5 | BLUE | VERTICAL LINE |

FIG. 8(C)

107

| ENTRY NUMBER (107A) | DATA LENGTH (107A) | OPERAND (107B) | | | |
|---|---|---|---|---|---|
| 1 | 3 | OPERAND 1 | OPERAND 2 | OPERAND 3 | |
| 2 | 2 | OPERAND 1 | OPERAND 2 | | |
| | | | | | |
| | | | | | |
| m | 4 | OPERAND 1 | OPERAND 2 | OPERAND 3 | OPERAND 4 |

IMAGE FORMING APPARATUS AND METHOD

BACKGROUND OF THE INVENTION

1. Field of the Invention

This invention relates generally to image forming apparatus in which each image frame is regarded as an aggregate of geometric image areas, and which particularly deals with videotex codes consisting of sequential codes composed of geometric codes which represent individual image areas as respective geometric drawings, and also characteristic or attribute codes representing attributes of the geometric drawings.

2. Related Application

U.S. Patent Application Serial No. 06/713,612, filed Mar. 19, 1985, by persons having a duty to assign to the assignee of the present application, and which is in fact assigned to said assignee, discloses subject matter related to the present application, and such disclosure is incorporated herein by reference Application Ser. No. 06/713,612 issued Feb. 24, 1987, as U.S. Pat. No. 4,646,134.

3. Description of the Prior Art

Digital image information transmitting systems for transmitting videotex and teletext information have been developed and used in various countries as new media of transmission of various kinds of image information via telephone circuits and radio waves. For example, a CAPTAIN PLPS system has been developed in Japan on the basis of the CAPTAIN (Character and Pattern Telephone Access Information Network) system, a NAPLPS (North American Presentation-Level-Protocl Syntax) system has been developed as a modification of the TELIDON system in Canada and is now the standard system for North American and a CEPT PLPS system has been developed in England based on the PRESTEL system.

In the NAPLPS system, each image frame is handled as an aggregate of geometric image areas, and videotex codes consisting of sequential codes composed of geometric codes representing individual image areas as respective geometric drawings and characteristic or attribute codes representing characteristics or attributes of the geometric drawings are transmitted. This system is highly rated as having a very high transmission efficiency as compared to other systems in which image information is made to correspond to mosaic picture elements, or systems in which image information is represented by other character codes.

In the NAPLPS system, five different geometric or PDI (Picture Description Instruction) codes, namely the codes [POINT], [LINE], [ARC], [RECTANGLE] and [POLYGON] are employed as basic geometric drawing commands. There are also characteristic or attribute codes which specify the logical pel size or line thickness, color and texture, respectively, of the geometric drawings formed according to the geometric codes, and codes specifying the operands (coordinate values) which define the positions on a viewing screen of the drawings formed according to the geometric codes.

In the NAPLPS system, the geometric or PDI codes, the characteristic or attribute codes and the codes representing the operands are transmitted in a predetermined time sequence, for example, in the order, characteristic or attribute codes for pel size, color and texture, PDI codes and then operand codes, with the attribute and PDI codes appearing in the sequence only when there is a change therein. Therefore, when transmitting digital image information in accordance with the NAPLPS system, the amount of image information transmitted can be greatly reduced, that is, a high image information transmission efficiency can be obtained. However, the information specified by any one of the geometric or PDI codes is incomplete and the definition of the respective geometric image area further requires the respective characteristic or attribute codes and operand codes. Therefore, alternations of the order or nature of the geometric codes or of the characteristic or attribute codes require very complicated operations. This means that a great deal of time is required for producing one frame of image information to be transmitted.

An image formed using the videotex code data noted above, can be advantageously expressed in various ways, for example, by overlaying one drawing over another drawing. As an example of the foregoing, a drawing of a bird may be overlaid upon a drawing of a sky with clouds or other suitable background, and the bird will appear to be in flight if the drawing thereof is periodically and suitably changed in its contours and/or colors. However, as noted before, the information specified by the geometric codes and also the data of the characteristic codes and operands are required for defining the image, so that alterations in the order of the geometric codes and/or alterations of the characteristic codes require very complicated operations, making it necessary to expend a great deal of time for producing each frame of the image information to be transmitted. It is particularly very difficult to select for alteration an underlying drawing concealed by an overlying drawing of an image composed of overlaying drawings, and to collect the selected drawing for its alteration or correction.

Further, when image information based on videotex codes is to be formed from a color video signal obtained by viewing with a video camera an original color image to be transmitted, a great deal of unnecessary or redundant information about the color hue, gradation, and the like is obtained. Such redundant information must be adequately reduced to a quantity suited for the data based on the videotex codes without sacrificing desired features of the original color image represented by the video signal.

Further, when character fonts and texture patterns are defined by the user, the defined character fonts and texture patterns must be accurately read out at the receiving side of the system. This indicates the need for providing information services corresponding to the functions of the apparatus at the receiving side of the system.

OBJECTS AND SUMMARY OF THE INVENTION

Accordingly, it is an object of this invention to provide an image forming apparatus which deals with videotex codes while avoiding the above-mentioned problems.

More particularly, it is an object of this invention to provide an image forming apparatus which deals with videotex codes arranged sequentially and composed of geometric codes representing individual areas as respective geometric drawings and characteristic codes representing attributes, such as, line thickness, color or texture of the geometric drawings, and which permits data correction operations, such as, the alteration of a characteristic code associated with a geometric code, and alteration of the order of the geometric codes, to be effected simply.

Another object of the present invention is to provide an image forming apparatus which deals with videotex codes consisting of sequential geometric codes representing individual image areas as respective geometric drawings and which permits the selecting and correcting of a drawing concealed by an overlaid drawing to be effected simply.

A further object of the present invention is to provide a videotex image forming apparatus, as aforesaid, which sequentially represents individual image areas of an original color image as respective geometric drawings defined by corresponding geometric codes and which can function automatically to perform a color selection for reducing the data to an amount suited for the videotex codes without spoiling or obliterating the features of the original color image.

A still further object of the present invention is to provide a videotex code image forming apparatus capable of defining selected dot patterns corresponding to a character or texture pattern so as to provide information services corresponding to the functions of the apparatus at the receiving side of the system.

The problems noted above are solved according to an aspect of the present invention by providing an image forming apparatus for dealing with sequential videotex codes composed of geometric codes representing individual image areas as respective geometric drawings and also characteristic codes representing attributes of the geometric drawings, with an order table for supervising the order of transmission of the geometric codes and characteristic codes, and a characteristic code table for supervising the characteristic codes, and by effecting correction or rearranging of the videotex code data on these tables.

According to another aspect of the present invention, an image forming apparatus for dealing with videotex codes consisting of sequential geometric codes representing individual image areas as respective geometric drawings is provided with means for selecting an intermediate one of successive images consisting of drawing areas represented by a series of videotex codes and reproducing the selected image on a monitor screen, and with means for designating a selected drawing area of the image reproduced on the monitor screen and effecting a videotex code correction or change with respect to the designated drawing area.

According to still another aspect of the invention, a videotex image forming apparatus, as aforesaid, has means for producing a histogram of the frequencies of occurrence of all colors represented by color data for each input color image and, in the event that the histogram is not excessively irregular, that is, the colors having high frequencies of occurrence are spread over the color spectrum, a predetermined relatively small number n of the colors having the highest frequencies of occurrence are selected and each image area has assigned thereto color data representing the one of the n selected colors closest to the actual color of the image area in question. On the other hand, if the histogram is too irregular, that is, the colors having the highest frequencies of occurrence are concentrated in only limited portions of the color spectrum, then the colors of the histogram are divided into N groups ($N>n$) arranged according to hue, the frequencies of occurrences of all colors in each of the N groups are totalled, the n groups which have the highest total frequencies of occurrence of the colors therein are selected, and the one color in each of the n groups which has the highest frequency of occurrence in the respective group is selected as one of the n colors to be designated or assigned to the several image areas.

According to another feature of the present invention, an image forming apparatus for dealing with videotex codes consisting of sequential geometric codes representing individual image areas as respective geometric drawing, is provided with pattern defining means for effecting pattern definition through selection and designation of a dot unit, means for altering the dot structure of the pattern defined by the pattern defining means, and means for generating a pattern definition code according to the dot structure designated by the dot structure altering means.

The above, and other objects, features and advantages of the invention will be apparent in the following detailed description of embodiments thereof when read in connection with the accompanying drawings.

BRIEF DESCRIPTION OF THE DRAWINGS

FIG. 8A is a schematic view showing the structure of an order table in the data supervision system;

FIG. 8B is a schematic view showing the structure of a characteristic code data table in the supervision system;

FIG. 8C is a schematic view showing the structure of a data table in the supervision system;

DESCRIPTION OF PREFERRED EMBODIMENTS

Figure 1A:
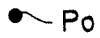
FIGS. 1A–1E are schematic diagrams showing respective drawing elements defined by PDI codes used in a NAPLPS system.
Figure 1B:
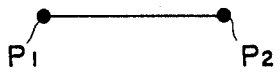
Figure 1C:
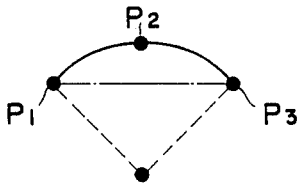
Figure 1D:
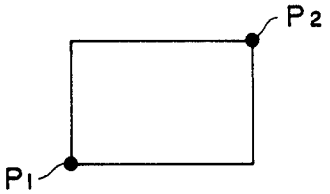
Figure 1E:
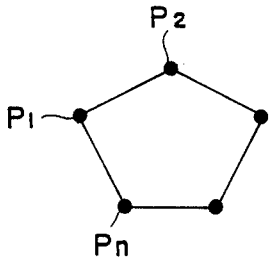

As earlier noted, in the NAPLPS system, there are five different geometric or PDI codes [POINT], [LINE], [ARC], [RECTANGLE] and [POLYGON] which correspond to respective basic geometric drawing elements. The geometric code [POINT] instructs setting of a drawing start point or plotting a point $P_0$ at given coordinates $(x_0,y_0)$ in a display plane as designated by respective operands, as shown in FIG. 1B. The geometric code [LINE] commands drawing of an line segment connecting two points $P_1$ and $P_2$ at given coordinates designated by respective operands, as shown in FIG. 1B. The geometric code [ARC] commands drawing of an arc connecting three points $P_1$,$P_2$ and $P_3$ at given coordinates in a display plane designated by respective operands, as shown in FIG. 1C. Alternatively, the code [ARC] may command drawing a chord connecting the two points $P_1$ and $P_3$ at the opposite ends of the arc noted above, as shown by a phantom line on FIG. 1C. The geometric code [RECTANGLE] commands drawing of a rectangle having a pair of diagonally situated vertexes at points $P_1$ and $p_2$ at given coordinates designated by respective operands, as shown in FIG. 1D. The geometric code [POLYGON]commands drawing of a polygon connecting points $P_1$,$P_2$ . . . , $P_n$ at given coordinates designated by respective operands, as shown in FIG. 1E. The geometric codes [ARC], [RECTANGLE] and [POLYGON] sometimes also command coloring of the area enclosed in the drawing with a color or a texture specified by respective characteristic or attribute codes.

In the NAPLPS system, the code data is arranged in a time sequence, for example, as shown in Table 1 below. In the illustrated case, a rectangle is designated by geometric code [RECTANGLE] at the 4-th order or place in the table, and such rectangle is to be drawn at coordinates designated by operands "1" and "2" appearing at the 5-th and 6-th orders or places with characteristics or attributes of logical pel size "1", designated in the 1-st order, a color "1" designated in the 2-nd order and a texture "1" designated in the 3-rd order. Then, another rectangle is to be drawn at coordinates designated by operands "3" and "4" in the 7-th and 8-th places or orders, respectively. Further, a pentagon is to be drawn, as specified by the geometric code [POLYGON] in the 10-th order or place with its vertexes at coordinates designated by the operands "1" to "5", respectively, in the 11-th to 15-th orders. Such pentagon is to have the attributes or characteristics defined by color "2" designated in the 9-th order or place, a logical pel size "1" designated in the 1-st order and a texture 1 designated in the 3-rd order.

TABLE 1

| Order | Code |
|---|---|
| 1 | Logical pel size 1 |
| 2 | Color 1 |
| 3 | Texture 1 |
| 4 | [RECTANGLE] |
| 5 | Operand 1 |
| 6 | Operand 2 |
| 7 | Operand 3 |
| 8 | Operand 4 |
| 9 | Color 2 |
| 10 | [POLYGON] |
| 11 | Operand 1 |
| 12 | Operand 2 |
| 13 | Operand 3 |
| 14 | Operand 4 |
| 15 | Operand 5 |

If, for example, it is desired to draw the pentagon, which is specified by the geometric code [POLYGON] at the 10-th place in Table 1, before drawing the rectangle specified, in the 4-th place of the table by the geometric code [RECTANGLE] at the coordinates designated by the 5-th and 6-th place or order operands "1" and "2", it would be necessary to check the location of the 4-th place or order geometric code [RECTANGLE] in advance because this geometric code is not followed by a fixed number of operands. In addition, the 9-th to 15-th place or order data would have to be shifted to locations before the 4-th place or order geometric code [RECTANGLE], and a characteristic code designating the color "1" would have to be inserted immediately before the 4-th place geometric code [RECTANGLE] in the rearranged table.

From the above, it will be appreciated that data corrections or changes, such as, alteration of the characteristic code associated with a particular geometric code, or alteration of the order in which the geometric codes appear in the time sequence, can be time-consuming procedures.

Figures 2, 2A:
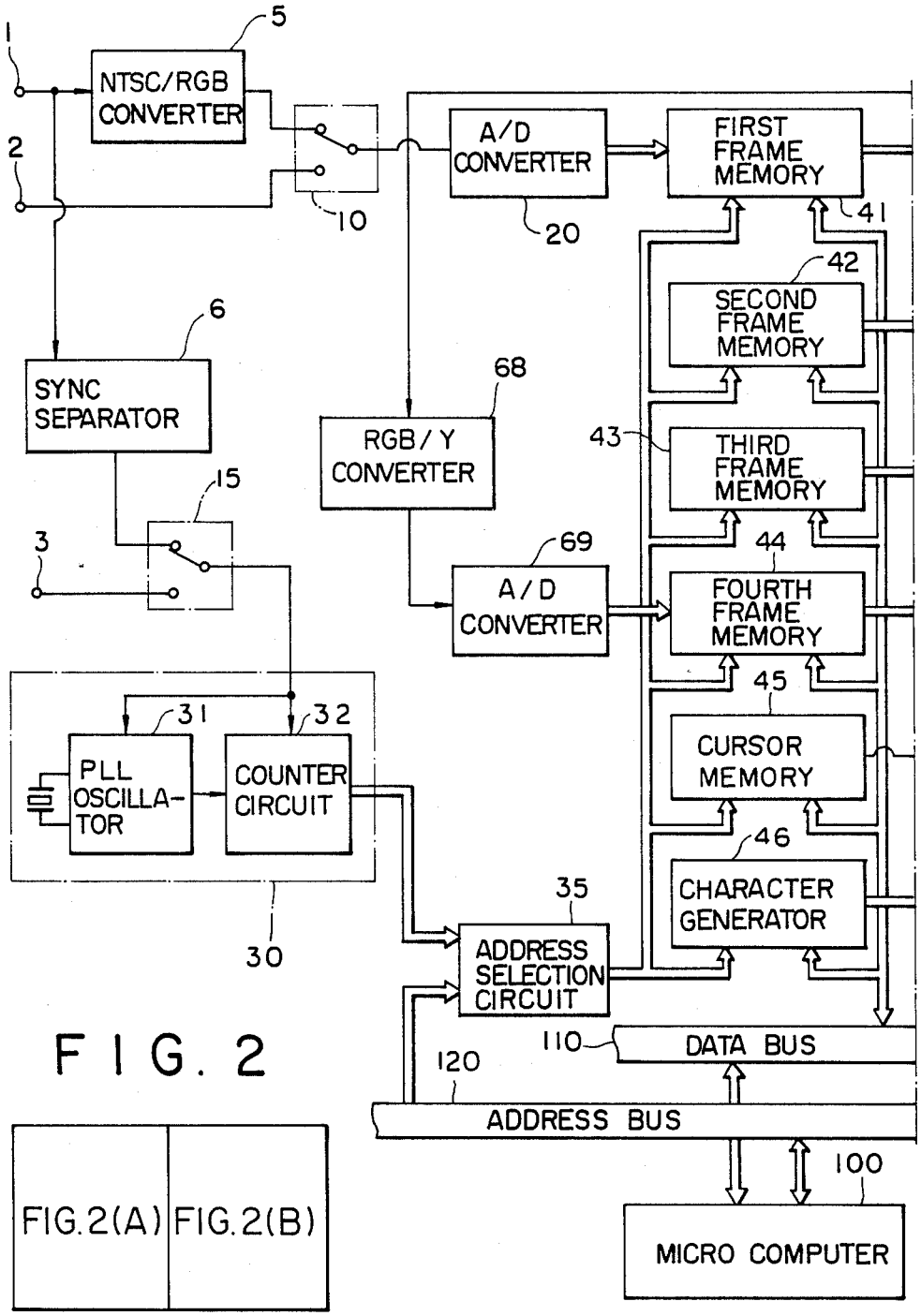
FIG. 2 is a block diagram showing an embodiment of the present invention applies to a videotex image forming apparatus for a NAPLPS digital image information transmitting system.
Figure 2B:
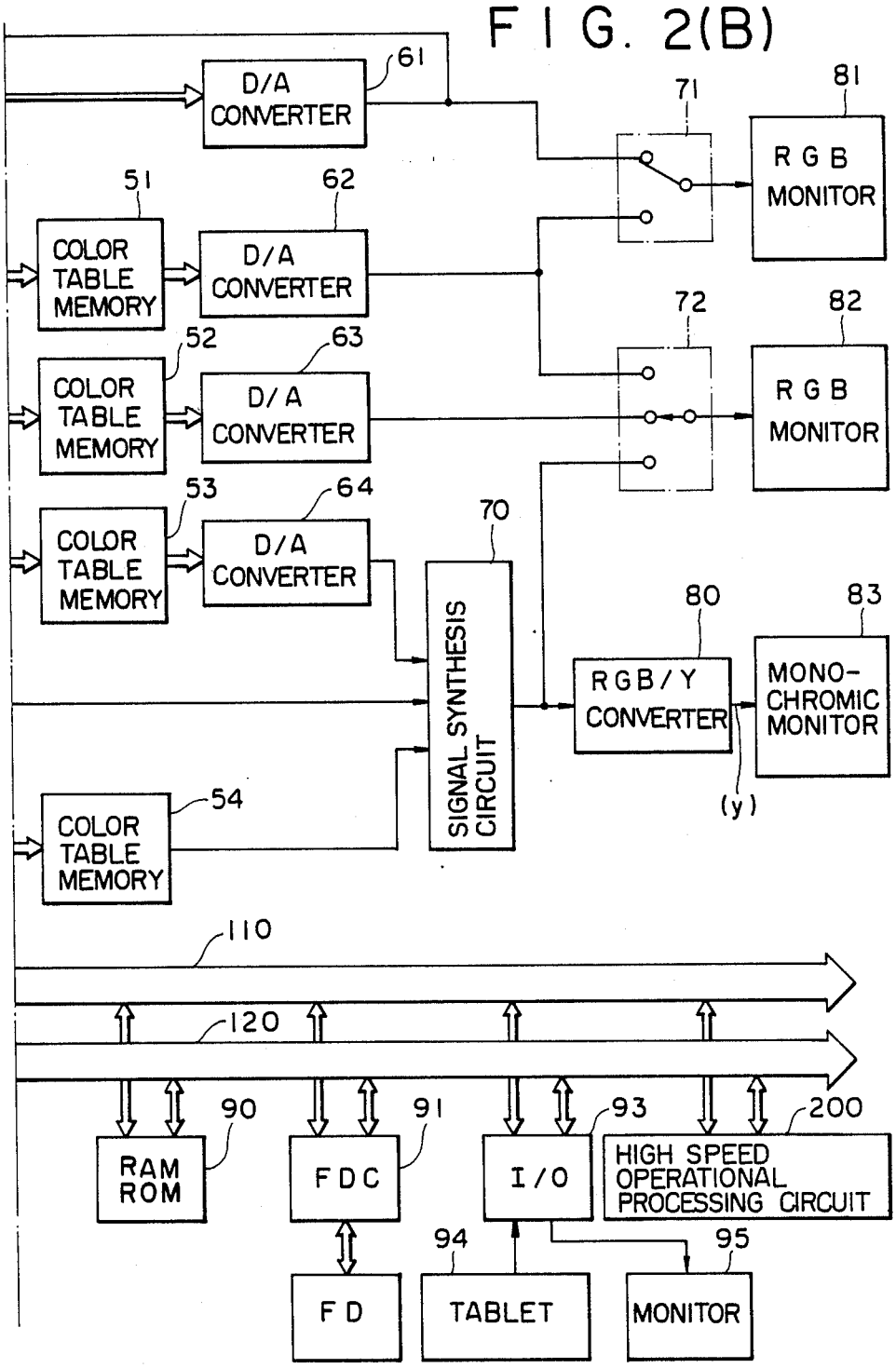

Referring now to FIG. 2, it is to be noted that a videotex image forming apparatus capable of facilitating the changing of the codes or their order in the time sequence is shown to be of a type particularly suited to be an image input unit for a digital image information transmitting system based on the NAPLPS standard. Generally, the videotex image forming apparatus receives an RGB color signal obtained from a color video camera (not shown) or a standard color television signal, such as, an NTSC color television signal. Each frame of the received color image is handled as an aggregate of geometric drawing areas or elements, and a microcomputer 100 (FIG. 2) automatically forms videotex code data transmitted via a data bus 110 and consisting of sequential codes which comprise geometric codes representing geometric drawings of elements or areas of the color image and characteristic codes representing the characteristics or attributes of the geometric drawings.

In the videotex image forming apparatus shown on FIG. 2, an NTSC color television signal is supplied through a first signal input terminal 1 to an NTSC/RGB converter 5 and to a sync separation circuit 6. An RGB color signal, for example, from a color video camera, is supplied through a second signal input terminal 2 to one input of a switch or input selection circuit 10.

The input selection or circuit switch 10 has a second input receiving the output of converter 5 and selectively passes either the RGB color signal obtained through conversion of the color television signal supplied from the first signal input terminal 1 or the RGB color signal supplied from the second signal input terminal 2. The selected RGB color signal is supplied from switch or circuit 10 to an analog-to-digital (A/D) converter 20.

The sync separation circuit 6 separates the sync signal from the NTS color television signal supplied to the first signal input terminal 1. The separated sync signal is supplied to one input of a sync switching circuit 15. A sync signal corresponding to the RGB color signal that is supplied to the second signal input terminal 2 is supplied to a third signal input terminal 3, and thence to a second input of sync switching circuit 15. The sync switching circuit 15 is in ganged or interlocked relation to input selection circuit 10 so that a sync signal corresponding to the RGB color signal supplied to A/D converter 20 is at all times supplied through switching circuit 15 to an address data generator 30. The address data generator 30 includes a PLL or phase locked loop oscillator 31 and a counter circuit 32. The counter circuit 32 counts output pulses of PLL oscillator 31 and provides therefrom address data synchronized with the sync signal being received by address data generator 30. The address data is supplied from generator 30 to an address selection circuit 35.

The address selection circuit 35 selectively passes either address data supplied thereto through an address bus 120 of microcomputer 100 or address data supplied from address data generator 30. The selected address data is supplied through an address bus extension 120' to first to fourth frame memories 41 to 44, respectively, a cursor memory 45 and a character generator 46. The transfer of various data to and from the first to fourth frame memories 41 to 44, cursor memory 45 and character generator 46 is effected via data bus 110 of the microcomputer 100.

The first frame memory 41 is connected to the output of A/D converter 20 and stores original image data. More particularly, the input color image data obtained through digitalization of the RGB color signal in A/D converter 20 is written, for each of the red, green and blue colors RGB, in memory 41 at addresses determined by address data generator 30. The original or input color image data stored in first frame memory 41 may be read out at any time. The read-out input color image data from memory 41 is converted, in a digital-to-analog (D/A) converter 61, into an analog RGB color signal which is supplied, in one condition of a first output selection circuit 71, to a first RGB monitor unit 81, whereby the original color image can be monitored or observed.

The second, third and fourth frame memories 42,43 and 44 are used as general-purpose memories for various types of data processing, such as, color processing and redundant data removal processing, of the original image data stored in first frame memory 41. Various image data involved in the data processings noted above are written in and read out of memories 42-44 via the data bus 110. The image data obtained as a result of the data processings and then stored in second frame memory 42, is converted, in a color table memory 51, into color data. Such color data is supplied from memory 51 to a D/A converter 62 and the analog RGB color signal which is output therefrom is supplied to another input of first output selection circuit 71. The output of D/A converter 62 is also connected to one input of a second output selection circuit 72 which has its output connected to a second RGB monitor unit 82. Therefore, after the data processings noted above, the resulting color image can be monitored on the first or second RGB monitor unit 81 or 82.

Image data obtained as a result of data processings and stored in third frame memory 43, is converted in a color table memory 52 into color data which is supplied through a D/A converter 63 for obtaining an analog RGB signal. The analog signal from converter 63 is supplied to another input of the second output selection circuit 72, so that the color image stored in third frame memory 43 after the data processings can be selectively monitored on the second RGB monitor unit 82. The analog RGB color signal obtained from D/A converter 61 through conversion of the original image data stored in first frame memory 41, is converted, in an RGB/Y converter 68, into a luminance signal Y. The luminance signal Y is digitalized in an A/D converter 69 to obtain monochromatic image data corresponding to the original color image. The monochromatic image data is stored in the fourth frame memory 44. The monochromatic image data obtained through redundant data removal and other processings of the monochromatic image data stored in memory 44 is supplied through a color table memory 53 and a D/A converter 64, whereby the analog RGB color signal is recovered and supplied to a signal synthesis circuit 70.

A cursor display signal is supplied from cursor memory 45 to signal synthesis circuit 70. The character generator 46 generates character data for displaying various control commands of the system. The character data are converted in a color table memory 54 into an analog RGB color signal which is supplied to the signal synthesis circuit 70. The signal synthesis circuit 70 generates a resultant RGB color signal, which combines the image represented by the image data stored in the fourth frame memory 44, the cursor image represented by the cursor display signal from the cursor memory 45 and the image represented by the character data from the character generator 46. The image represented by the RGB color signal from the signal synthesis circuit 70, is supplied to another input of output selection circuit 72 and is supplied to a second RGB monitor unit 82. The RGB color signal from circuit 70 is also supplied to an RGB/Y converter 80 to obtain a luminance (Y) signal which may be monitored on a monochromatic monitor unit 83.

In this embodiment, the microcomputer 100 serves as a system control for controlling the operation of the entire apparatus. To its data bus 110 and address bus 120 are connected an auxiliary memory 90, shown to include a ROM and a RAM, a floppy disk controller 91, an input/output interface circuit 93 and a high speed operational processing circuit 200. To the input/output interface circuit 93 are connected a tablet 94 on which a user may write or draw with a stylus for providing various data for manual editing and a monitor 95 therefor.

Figure 3:
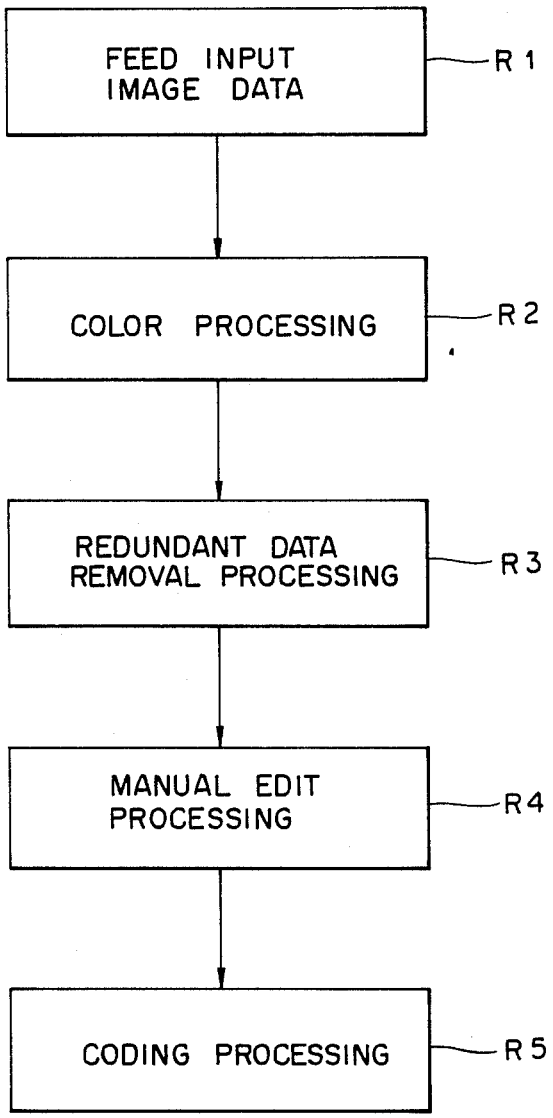
FIG. 3 is a flow chart showing an image processing procedure employed in the apparatus of FIG. 2.

In the apparatus according to this embodiment, input image data is processed in the manner shown in the flow chart of FIG. 3, which represents a program whereby input color image data supplied through A/D converter 20 to the first frame memory 41 is automatically converted to geometric command data which is transmitted via data bus 110.

More specifically, in a routine Rl of FIG. 3, the input color image data from A/D converter 20 is first written in first frame memory 41 to be there stored as original image data. The input color image data may be selected from either the NTSC color television signal applied to terminal 1 or the RGB color signal applied to terminal 3 through switching of the input selection circuit 10 and the sync switching circuit 15. The original image data stored in first frame memory 41 is converted by RGB/Y converter 68 into monochromatic or luminance image data which is digitalized in A/D converter 69 and stored in fourth frame memory 44.

Then, in a routine R2, color processing is performed on the input color image data according to the image data stored in the first and fourth frame memories 41 and 44. Subsequently, processing for redundant data removal is performed in a routine R3, so as to obtain image data suited for final conversion to geometric command data without losing the features of the original image.

Figure 4:
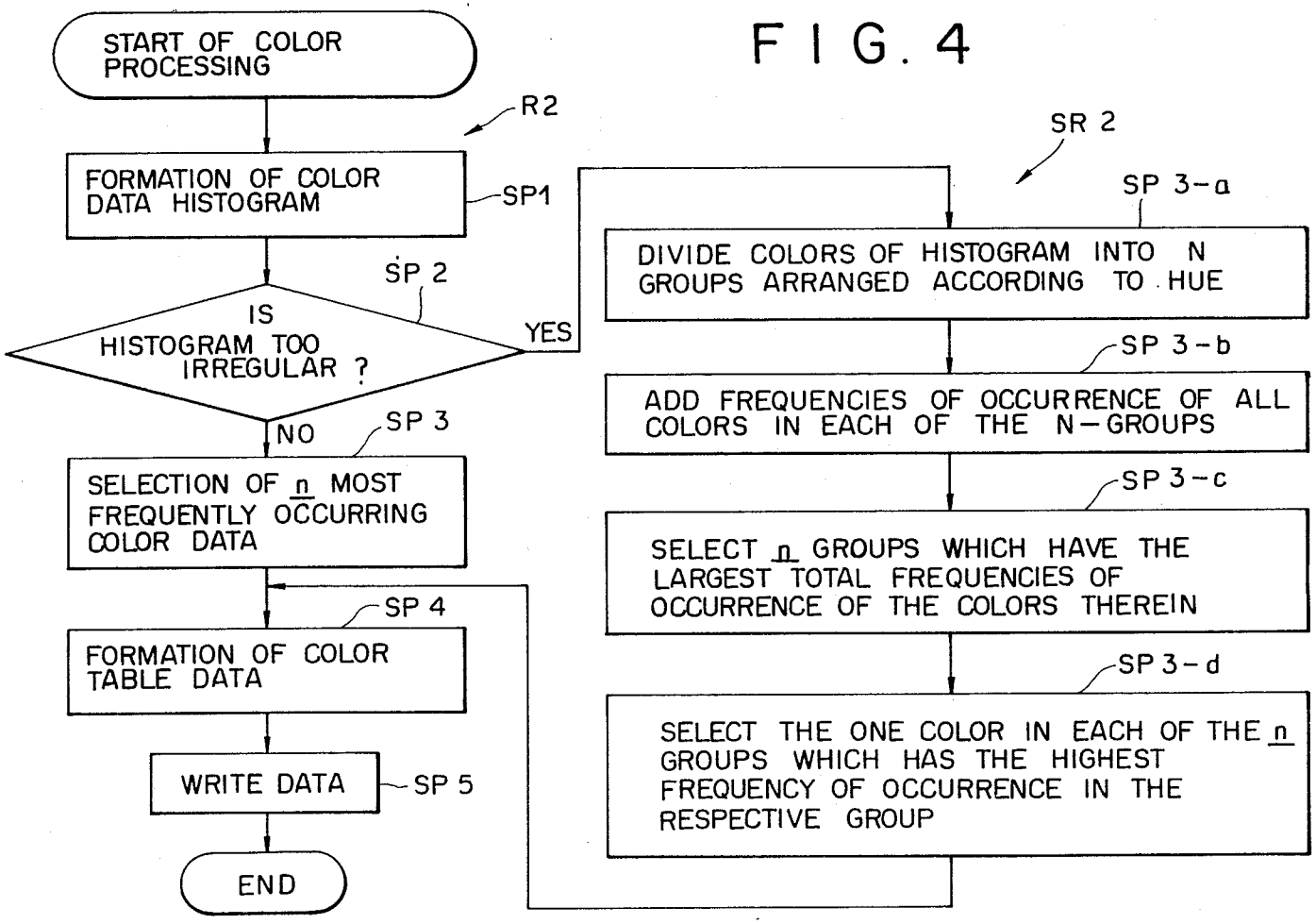
FIG. 4 is a flow chart showing a color processing procedure employed in the apparatus of FIG. 2.

More specifically, in a first step SP1 of the color processing routine R2 as illustrated by the flow chart of FIG. 4, the high speed operational processing circuit 200 produces a histogram for the frame of input color image data stored in first frame memory 41. As shown on FIG. 5, such histogram indicates the frequency with which each of a large number of colors, for example, 4096 colors, arranged according to hue, occurs in the input color image data stored in first frame memory 41.

The resulting histogram is analyzed in step SP2 to determine the spread across the spectrum of the colors occurring most frequently. If the color occurring most frequently in the histogram are distributed across the spectrum, that is, the histogram is not too irregular, the color processing routine proceeds to a step SP3 in which n different colors, for example, 16 colors, of the histogram having the highest frequencies of occurrence are selected automatically. Then, in a step SP4, the one of the n colors that most closely resembles the color of each image area of the original color image is allotted to that image area or element on the basis of its having the same luminance as the respective image area in the monochromatic image represented by the monochromatic image data stored in fourth frame memory 44. Color table data is thus produced with a minimum deviation of the specified color from the actual color for each picture element. The color table data formed in this way in the high speed operational processing circuit 200, is stored, in the next step SP5, in color table memories 51,52 and 53. The image data, after the color processing in which the n colors are allotted to the individual image areas or elements, is also written in second frame memory 42.

However, in the event that the most frequently occurring colors in the input color image data are concentrated in limited portions of the color spectrum, as would be the case when the original color image is largely made up of a background portion colored with variations of one color, then the selection of the 16 or other small number of the most frequently occurring colors would only make it possible to allot one of those selected colors to each image area or element of the background portion for accurately expressing the color hue of the latter. However, foreground portions of the image which occupy relatively small areas thereof would not be likely to closely correspond, in their actual colors, to any of the 16 colors selected on the basis of their frequency of occurrence. Therefore, there would be rather coarse or inaccurate designation of the colors for small, but nevertheless important image areas.

Figure 5:
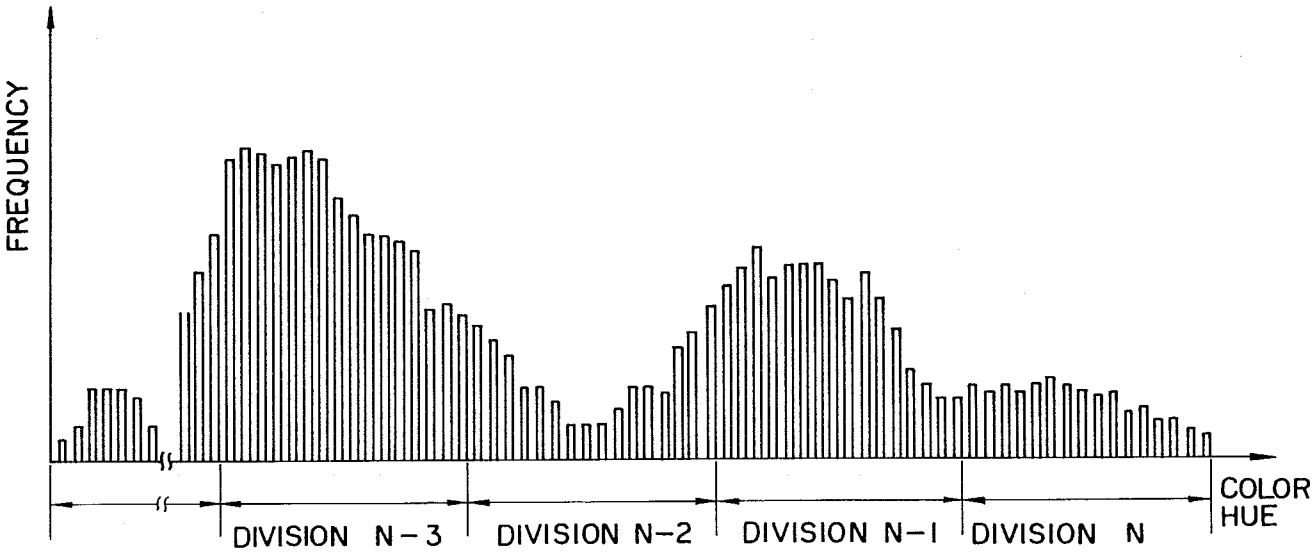
FIG. 5 is a chart showing a histogram and to which reference will be made in explaining the color processing procedure.

Therefore, in the color processing routine R2 according to this invention, if the analysis of the histogram in step SP2 determines that the histogram is too irregular, that is, the most frequently occurring colors are concentrated in one or more limited portions of the color spectrum, for example, as in the histogram of FIG. 5, the program proceeds to an alternate or sub-routine SR2 in which, in a first step SP3-a, the colors of the histogram are divided into N groups arranged according to hue, with $N>n$. For example, in the case where there are 4096 different colors in the histogram and the red, green and blue colors R,G and B are each represented by 4-bit data, N may be conveniently 64 or 256. Then, in step SP3-b, the frequencies of occurrence of all colors in each of the N groups are added to provide a total frequency of occurrence for each group. In the next step SP3-c, selection is made of the n, for example, 16, groups which have the largest total frequencies of occurrence of the colors therein. In the final step SP3-d of sub-routine SR2, high speed operational processing circuit 200 selects the one color in each of the n selected groups which has the highest frequency of occurrence in the respective group. Thus, n or 16 colors are selected to be allocated to the various image areas of the original color image in step SP4 of the color processing routine R2 as described before.

It will be appreciated that, in accordance with the present invention, optimum color designation can be obtained in respect to all portions of the input color image even though such image may have relatively large background or other portions that are largely monochromatic. Further, the amount of data for specifying the colors is adequately reduced so as to be consistent with the videotex codes without sacrificing features of the original color image.

The color image obtained through the color processing described above may be monitored on the first or second RGB monitor unit 81 or 82 by reading out the individual color data from first frame memory 41 with the image data stored in second frame memory 42 as address data.

Upon completion of the color processing routine R2, the program proceeds to the redundant data removal processing routine R3 in which redundant data unnecessary for the conversion of data into geometric commands is removed to reduce the quantity of information. Such redundant data removal is effected through noise cancellation processing, intermediate tone removal processing, and small area removal processing of the image data stored in second and fourth frame memories 42 and 44.

After a routine R4 in which manual editing is effected, as hereinafter described in detail, the program proceeds to a routine R5 in which the processed color image data is coded or converted into geometric commands. In this routine R5, the boundary between adjacent image areas is followed by high speed operational processing circuit 200, the coordinates of individual vertexes are detected, and these coordinates are converted, as the respective vertexes of a geometric drawing, into geometric commands based on the PDI codes noted above. In addition, the coordinates of necessary vertexes are given as operands and characteristic or attribute data as to logical pel size, which is the thickness of the borderline, color, and texture of the geometric drawing, are given in advance.

In the embodiment being here described, manual edit processing can be effected to manually add a new motif, shift or remove a drawing, or change a color in a color image represented by a series of geometric codes obtained in the above manner.

The manual edit processing is effected with the transparent tablet 94 or with a so-called mouse (not shown) provided on the screen of the second RGB monitor unit 82.

More specifically, a character information image is provided on the screen of the second RGB monitor unit 82 by the character generator 46 as a display of various control commands that are necessary for the manual edit processing. At the same time, a cursor image for the cursor display is provided from the cursor memory 45 as position information on the tablet 94. The operator may effect correction of the image using a pen or stylus associated with tablet 94. The result of such correction is displayed as a real-time display.

Figure 6A:
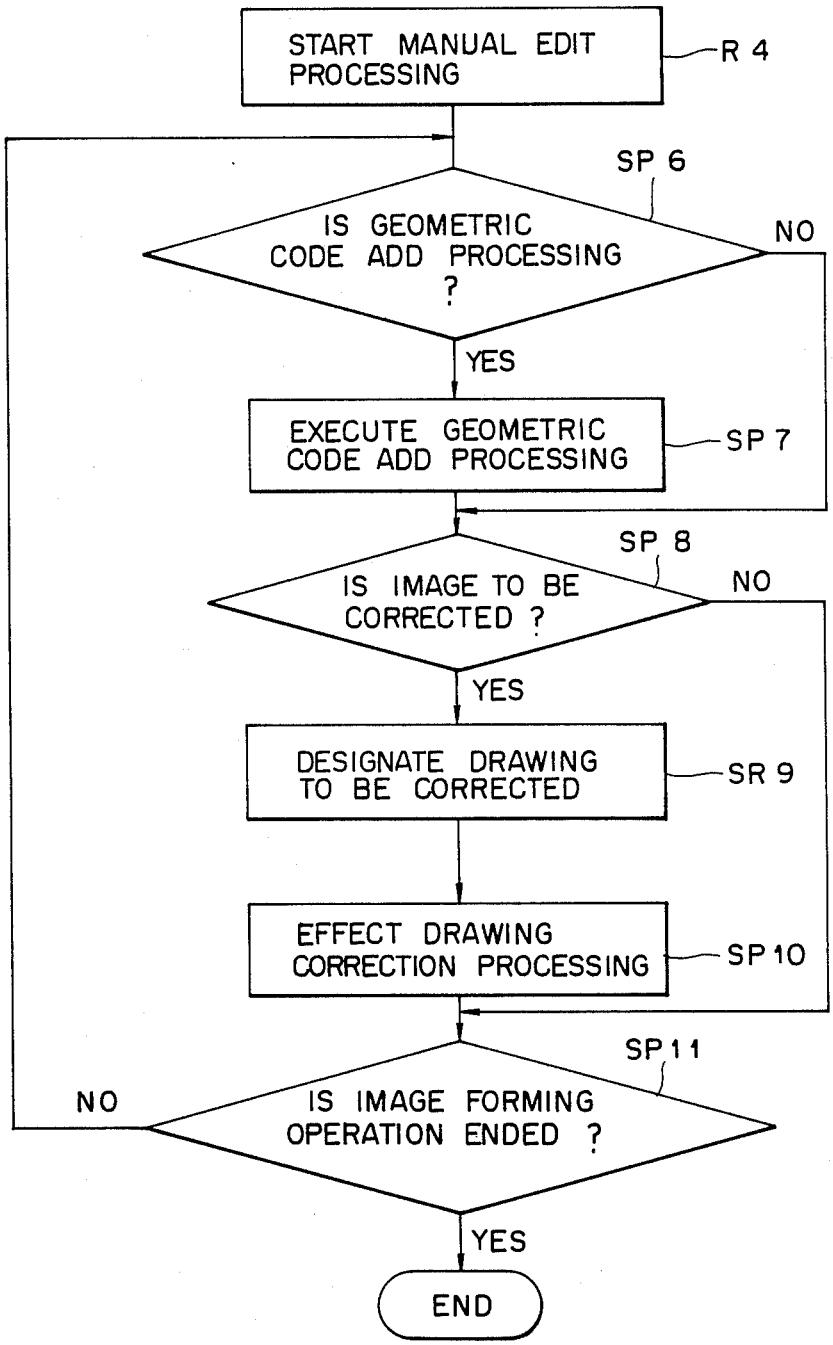
FIG. 6A is a flow chart showing a manual edit processing procedure employed in the apparatus of FIG. 2.

The manual editing routine R4 will now be described with reference to the flow chart of FIG. 6A. First, in step SP6, there is a check to determine whether geometric code add processing is designated. If geometric code add processing is designated, a geometric code representing a new geometric drawing to be provided is added in step SP7 by operating the tablet 94. If no geometric code add processing is designated, or after the geometric code add processing noted above has been executed, it is determined in step SP8 whether image correction processing is designated. If image correction processing is designated, the geometric drawing constituting the area of the image to be corrected is designated in a subroutine SR9 by operating the tablet 94. Then, a necessary correction is executed with respect to the drawing in step SP10, for example, by adding a geometric code corresponding to a new geometric drawing to be provided. If the result of the check in step SP8 is NO, that is, no drawing correction processing is designated, or after the drawing correction processing noted above has been completed, it is checked or determined in step SP11 whether the image forming or manual edit operation has been completed. The routine R4 is thus ended or returns to step SP6 for again checking whether geometric code add processing is designated. The routine R4 described above is repeatedly executed.

Figure 6B:
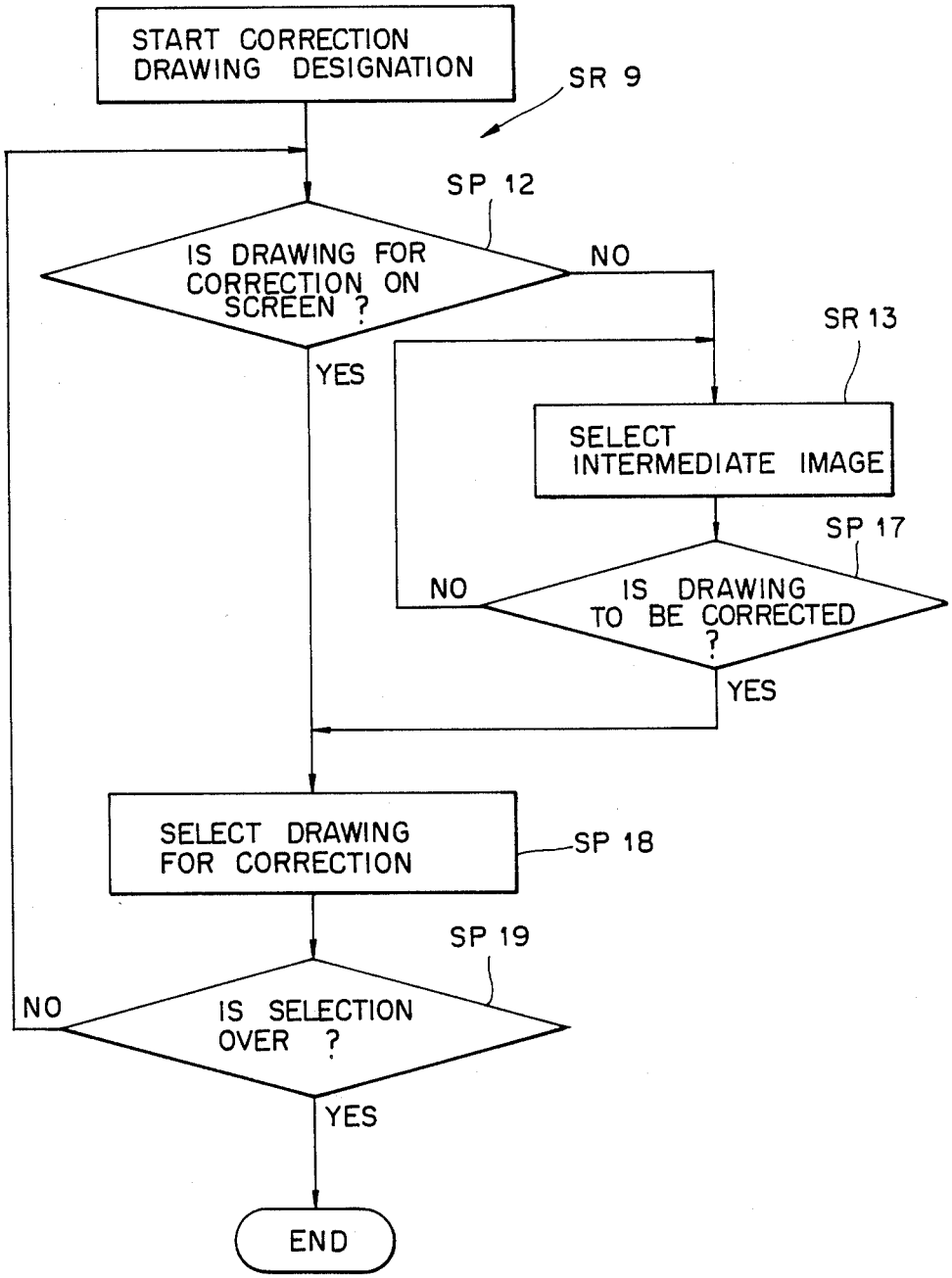
FIG. 6B is a flow chart showing a procedure for a drawing designation operation in the manual edit processing of FIG. 6A.

The operation of subroutine SR 9 for designating a geometric drawing to be corrected or changed is shown by the flow chart of FIG. 6B. More specifically, in step SP12, it is determined whether the drawing to be corrected is on the screen of the second RGB monitor unit 82. If the drawing to be corrected is on the screen, that drawing is immediately designated by operating tablet 94. If the drawing to be corrected is not on the screen of monitor unit 82, an intermediate image selection operation or subroutine SR13 is repeatedly performed until the image constituting the geometric drawing to be corrected appears on the screen. Then, the geometric drawing to be corrected is designated by operating tablet 94. When a drawing to be corrected is designated by operation of tablet 94, the correction processing noted above with reference to step SP10 in FIG. 6A is executed.

Figure 6C:
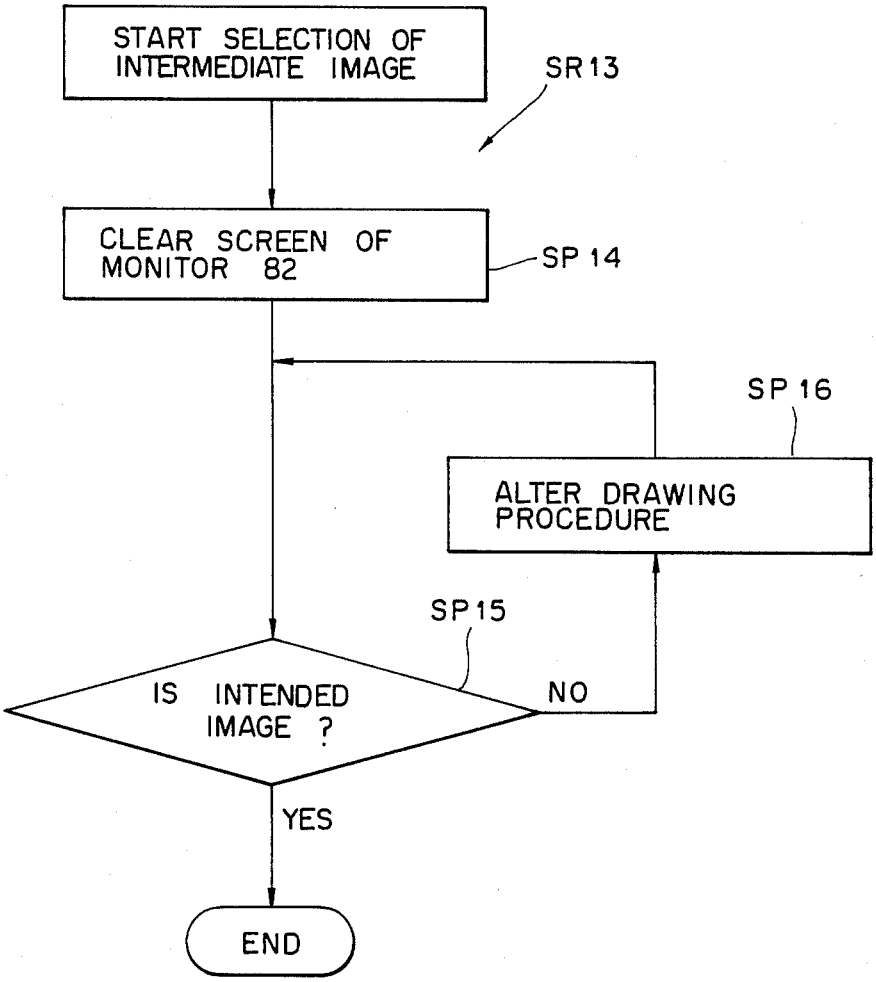
FIG. 6C is a flow chart showing a procedure for selecting an intermediate image in the drawing designation operation of FIG. 6B.

The intermediate image selection operation or subroutine SR13 is shown in detail by the flow chart of FIG. 6C. More specifically, when the intermediate image selection mode is set, microcomputer 100, in step SP14, clears the image displayed on the screen of the second RGB monitor unit 82. Then images that have been processed are sequentially reproduced in the order, in which they are processed, by operating tablet 94. The designation of the images by the operation of tablet 94 may be effected either one image after another, or a plurality of images at a time either forwardly or backwardly. Each image that is reproduced or displayed is checked in step SP15 and, if the displayed image is not the intended one, the next image is ordered in step SP16. If the desired image is perceived in step SP15, the operation returns to subroutine SR9 in which it is checked, in step SP17, whether or not the selected intermediate image contains a geometric drawing or image area which is to be corrected. The geometric drawing or image area which requires correction is then selected in step SP18 and, in the next step SP19, it is determined whether the selection process is ended prior to return to routine R4 at step SP10.

As has been shown, in the manual edit processing according to this invention, the individual images may be reproduced one by one, in the order in which they are processed, so that an intermediate image can be selected. In this way, even a drawing which is concealed by a subsequently provided image may be simply located or designated and then subjected to a necessary correction processing. More specifically, an intermediate image is selected from among the images reproduced on the screen of monitor 82 for videotex code correction processing with respect to a specified one of the drawing areas defined by a series of videotex codes and constituting the image. By this method, it is possible to easily effect correction processing of a videotex image, such as, selectively correcting a drawing which is concealed by an overlaid drawing in the case when the image is constituted by a plurality of drawings overlaid one upon another.

Figure 7:
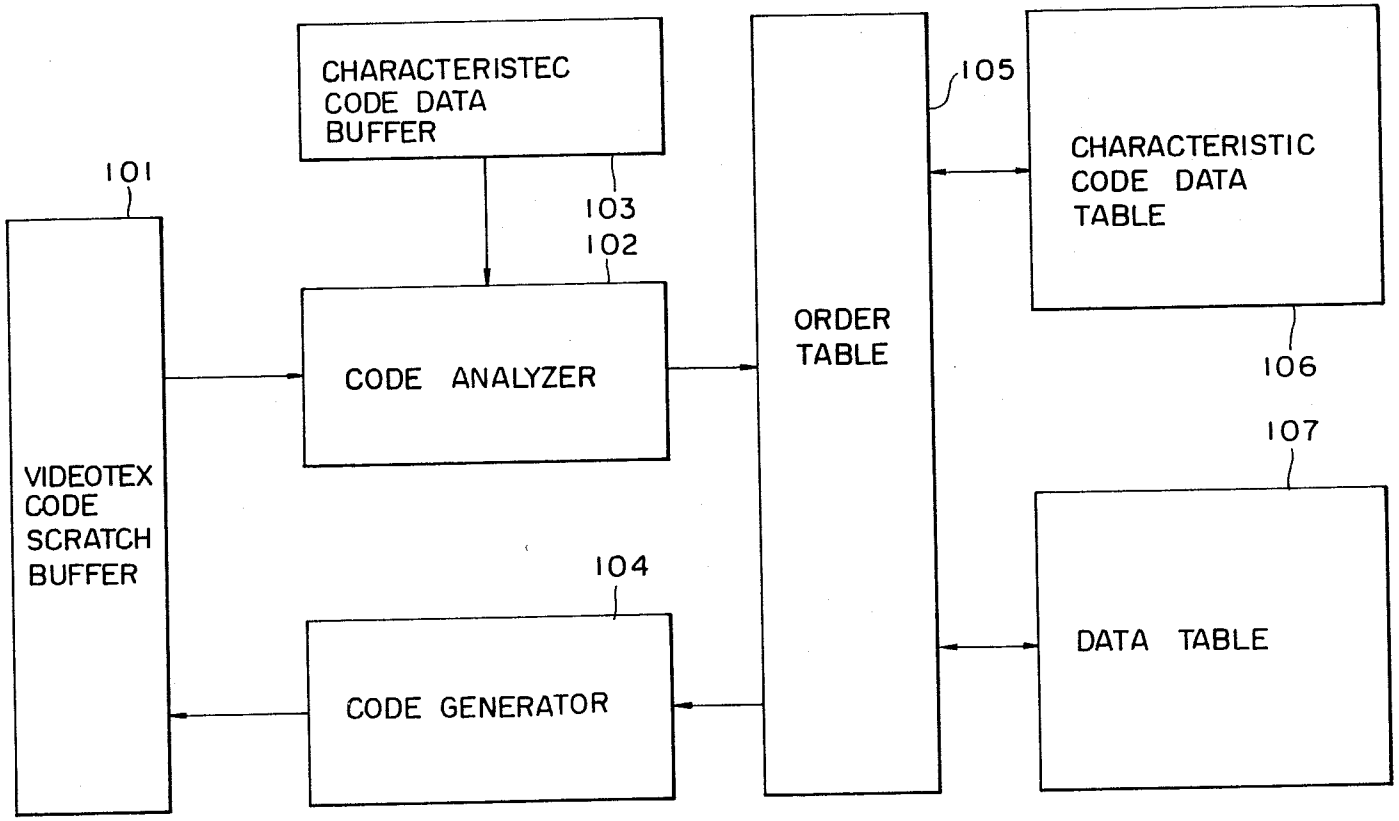
FIG. 7 is a block diagram of an arrangement for supervising various data dealt with in the apparatus of FIG. 2.

In accordance with this invention, the handled data, that is, the geometric codes and characteristic codes noted above, are supervised by a supervising system, for example, the system schematically shown in FIG. 7, which is constituted by microcomputer 100 and its memory 90 and by software for the computer.

The illustrated supervising system includes a videotex code scratch buffer or file 101 in which videotex codes formed in the above way are temporarily stored. A sequence of videotex codes stored in videotex code scratch buffer 101 are analyzed and disassembled by a code analyzer 102 into a form suited for ready supervision. A characteristic or attribute code data buffer or file 103 holds characteristic code data at the prevailing instant of the time sequence of the analysis of the videotex codes in code analyzer 102. A code generator 104 is provided for generating videotex codes that are supplied to videotex code scratch buffer 101 from data given by an order table 105, a characteristic code data table 106 and a data table 107. More particularly, order table 105 supervises the order of the geometric codes of the videotex codes, pointers for entries to characteristic code data table 106 and data table 107 and various flags indicative of the image formation state. The characteristic code data table 106 supervises the characteristic or attribute codes, and data table 107 supervises non-fixed length operands of the geometric codes.

The order table 105 is shown in FIG. 8A to have a geometric code column 105A which shows geometric codes, a characteristic pointer column 105B which holds pointers to the characteristic code data table 106, a data pointer column 105C which holds pointers to the data table 107 and a flag column 105D which shows various flags necessary for the image formation. Various data are entered in the respective columns of order table 105 in the order of the geometric code portion of the videotex codes.

The characteristic code data table 106 is shown in FIG. 8B to have a logical pel size column 106A which shows the line thickness for the drawing, a color data column 106B which shows the color, and a texture column 106C which shows patterns. Various data are entered in the respective columns of table 106 in the order of the pointers shown in the characteristic pointers column 105B of order table 105. In other words, the numbers appearing in the characteristic pointer column 105B of table 105 correspond to the entry numbers in table 106.

The data table 107 is shown in FIG. 8C to have a data length column 107A which shows the number of bytes of data that are entered, and operand columns 107B in which operand groups for non-fixed length geometric codes are entered. Various data are entered in respective columns of data table 107 in the order of pointers appearing in the data pointer column 105C of order table 105. In other words, the numbers appearing in the data pointer column 105C of table 105 correspond to the entry numbers in table 107.

In accordance with the invention, the videotex codes are temporarily stored in the videotex code scratch buffer 101 when dealing with the previously made videotex code data. The time sequential videotex code data stored in videotex code scratch buffer 101 are sequentially analyzed by code analyzer 102. If that analysis indicates that mere alteration of a characteristic or attribute code defining the logical pel size, color, or texture is to be effected, the contents of characteristic code data buffer 103 are altered. If the result of the analysis by code analyzer 102 is that a geometric code for forming a drawing is to be altered, the changed geometric code is registered in the geometric code column 105A of order table 105. As for the operand portion of the code, the data length thereof is obtained and is registered in the data length column 107A and operand column 107B of data table 107. The entry number identifying each operand portion is registered in the data pointer column 105C of the order table 105 next to the corresponding geometric code. Each entry in the characteristic code data table 106 is formed from data in the characteristic code data buffer 103, and the respective entry number from table 106 is registered in the characteristic pointer column 105B of order table 105, again next to the corresponding geometric code. When a series of the foregoing registering operations has been completed, code analyzer 102 again performs analysis of the contents of videotex code scratch buffer 101, and the series of registering operations is repeated. In any one of the above series of registering operations, if the contents of the characteristic code data buffer 103 are not altered from the contents appearing therein in a previous operation, the same entry number as for the previously registered characteristics is entered in the characteristic pointer column 105B of order table 105 and a new entry is not made in characteristic code data table 106.

Thus, a time sequence of videotex code data is produced in the order of entry to order table 105 from the data registered in tables 105,106 and 107. First, characteristic or attribute codes for altering the logical pel size, color, and texture are stored in videotex code scratch buffer 101 according to the contents of characteristic code data table 106 identified by the entry number corresponding to the number appearing in the characteristic pointer column 105B of order table 105. Then, a geometric code appearing in the geometric code column 105A of order table 105 is stored in videotex code scratch buffer 101. After the geometric code data in scratch buffer 101, there are added the respective operand data appearing in the columns 107B of table 107 next to the entry number which is given in the data pointer column 105C. The series of operations noted above is repeated to produce time sequential videotex code data for drawing the desired image. In producing such time sequential videotex code data, there is no need to produce a code for defining the characteristics or attributes corresponding to a particular geometric code, provided the content or number in characteristic pointer column 105B, which corresponds to the geometric code immediately before produced, coincides with the content or number in the characteristic pointer column 105B, which corresponds to the geometric code being considered in column 105A of the order table 105. Further, even if the characteristic code data pointers respectively associated with successive geometric codes in order table 105 are not the same, that is, the contents in table 106 next to the respective entry numbers are not identical, it is possible to omit the generation of the characteristic or attribute alteration code for increased efficiency of code generation when there is at least partial coincidence between the contents in table 106 next to said respective entry numbers. Thus, for example, if the contents in table 106 corresponding to pointer "6" in column 105B of table 105 differ from the contents in table 106 next to entry number "1" only in respect to the "Pel Size" in column 106A, then only an altered code for the pel size has to be provided and appropriately stored in buffer 101.

As has been shown, in the above-described embodiment of the invention, the correction of data is effected on order table 105, which supervises the order of transmission of separately provided geometric codes and characteristic codes (videotex code data), and on characteristic code data table 106 for supervising the characteristic codes. Thus, it is possible to increase the freedom of data handling and to realize high speed processing.

Figure 9:
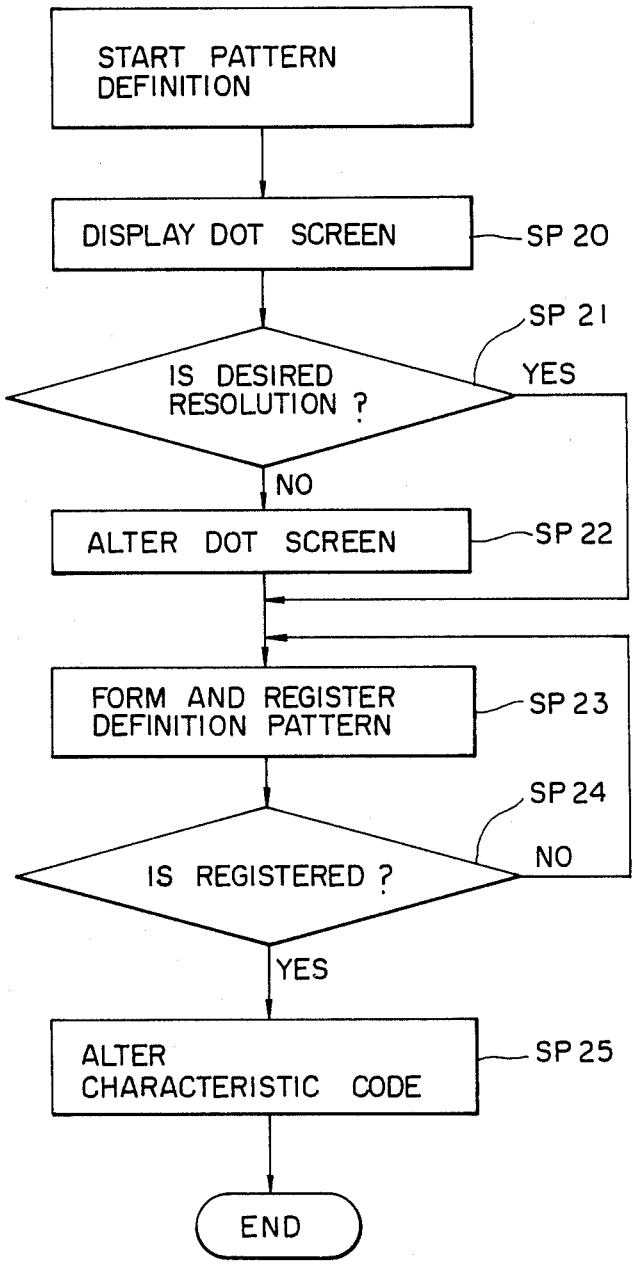
FIG. 9 is a view for explaining a pattern defining function of the apparatus embodying this invention.

Further, in the illustrated embodiment of the invention, desired character fonts and texture patterns of the videotex codes that are handled can be defined in a procedure as shown in the flow chart of FIG. 9.

Figure 10A:
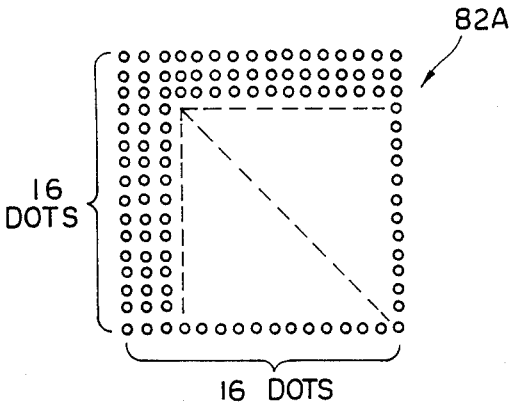
FIGS. 10A–10C are schematic views showing examples of dot structures obtained by the pattern defining function explained with reference to FIG. 9.
Figure 10B:
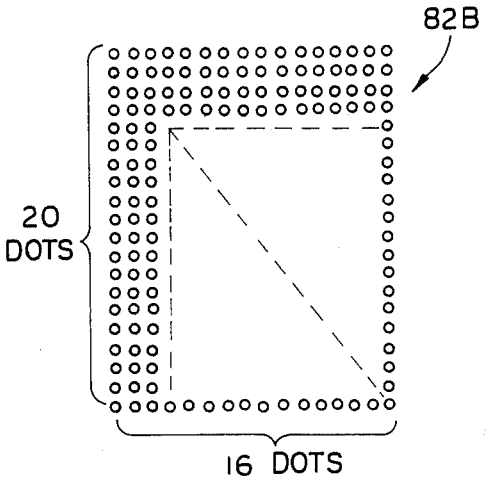
Figure 10C:
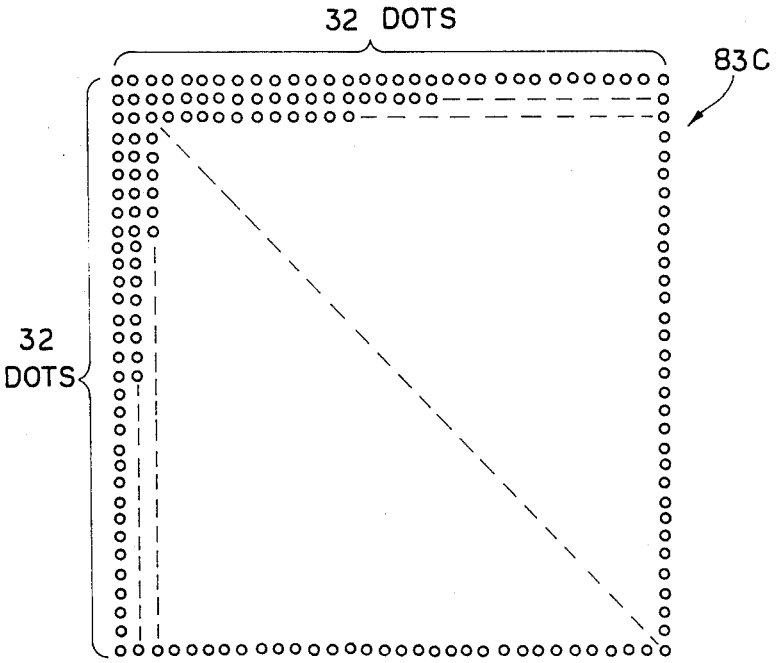

More specifically, in the program of FIG. 9, when the mode for setting of pattern definition is selected, microcomputer 100 is operative in step SP20 to cause a designated dot structure frame to be displayed on monitor unit 82. For example, the designated dot structure frame may be selected from among a 16-by-16 dot frame 82A shown in FIG. 10A, a 16-by-20 dot frame 82B shown in FIG. 10A–B and a 32-by-32 dot frame 82C shown in FIG. 10C. The user checks, in step SP21, whether the dot frame displayed on the screen of second RGB monitor unit 82 coincides with the desired dot structure corresponding to the functions of the apparatus at the receiving side of the system, that is, the resolution of the decoder provided in the receiving side apparatus. In the absence of coincidence in step SP21, the user selects another one of the dot frames of FIGS. 10A–10C for display on the screen of monitor unit 82, thereby altering the dot screen, as in step SP22, until the desired coincidence is achieved. Then, the user forms a definition pattern through selection of the dot unit, and the pattern is registered with respect to the dot frame displayed on the screen of monitor unit 82 by operating tablet 94 or the keyboard, as in step SP23. Registration is checked in step SP24 and, when registration is attained, microcomputer 100 is operative in step SP25 to alter the characteristic or attribute codes for the logical pel size and the like by generation of a pattern definition code conforming to the designated dot structure 82A,82B or 82C. The character font or texture pattern that is newly defined in the above way, is decoded with a designated resolution for monitoring on the screen of second RGB monitor unit 82.

It will be appreciated from the foregoing, that, in the image forming apparatus according to this invention for dealing with videotex codes consisting of sequential geometric codes representing respective areas of an image as geometric drawings, a pattern is defined through selection and designation of the dot unit, and the dot structure of the pattern thus defined is altered as desired. A character font or texture pattern is thus defined to produce a pattern definition code corresponding to the functions of the receiving side apparatus. The pattern definition code thus defined is used for the videotex image formation. In this way, it is possible to provide information services corresponding to the functions of the receiving side apparatus.

Although illustrative embodiments of the invention have been described in detail herein with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An image forming apparatus for dealing with videotex codes consisting of a sequential arrangement of geometric codes representing individual image areas as respective geometric drawings and also characteristic codes representing attributes of said geometric drawings, said apparatus comprising:

means for effecting transmission of said geometric codes and characteristic codes;

an order table for supervising the order of transmission of said geometric codes and characteristic codes;

a characteristic code table communicating with said order table and enabling selection of said characteristic codes; and means for analyzing data in said tables and effecting changes therein.

2. An image forming apparatus according to claim 1; in which said order table has characteristic code data pointers entered therein in the order of the sequential arrangement of the respective geometric codes, and said characteristic codes are entered in said characteristic code table in the order designated by said characteristic code data pointers.

3. An image forming apparatus according to claim 2; in which said order table further has data table pointers entered therein in the order of the sequential arrangement of the respective geometric codes; and further comprising a data table having data length and operand codes entered therein in the order designated by said data table pointers.

4. An image forming apparatus according to claim 3; in which said means for effecting changes in data on said tables includes videotex code scratch buffer means in which the videotex codes are temporarily stored, code analyzing means interposed between said scratch buffer means and said order table, and code generator means for entering sequential videotex codes in said scratch buffer means as directed by said order table.

5. An image forming apparatus according to claim 1; which said means for effecting changes in data on said tables includes videotex code scratch buffer means in which the videotex codes are temporarily stored, code analyzing means interposed between said scratch buffer means and said order table, and code generator means for entering sequential videotex codes in said scratch buffer means as directed by said order table.

6. An image forming apparatus according to claim 1; further comprising:

a monitor screen;

means controlled by a user of the apparatus for selecting an intermediate one of a plurality of overlying images each consisting of different sets of said respective geometric drawings represented by a series of videotex codes and reproducing the selected image on said monitor screen; and means for designating one of said respective geometric drawings of the selected image reproduced on said monitor screen and effecting a videotex code correction processing with respect to said designated geometric drawing;

whereby manual edit processing is performed.

7. An image forming apparatus according to claim 6; further comprising:

means operative prior to said manual edit processing for generating said series of videotex codes in response to input color image data; and means for producing a histogram of the frequencies of occurrence of all colors represented by said input color image data, determining whether colors having high frequencies of occurrence are spread across the spectrum of said colors and, if colors having high frequencies of occurrence are spread across the spectrum of said colors, selecting a predetermined number n of the colors having the highest frequencies of occurrence and assigning to each of said individual image areas the color data representing the one of said n selected colors closest to the color of the respective individual image area;

whereby color processing is performed.

8. An image forming apparatus according to claim 7; further comprising means operative, if during said color processing said colors having high frequencies of occurrence are concentrated in only limited portions of said spectrum, for dividing said colors of the histogram into N groups ($N>n$) arranged according to hue, totalling the frequencies of occurrence of all colors in each of said N groups, selecting the n groups which have the highest total frequencies of occurrence of the colors therein, and determining the colors which have the highest frequencies of occurrence in said n groups, respectively, as said n colors to be assigned to said individual image areas.

9. An image forming apparatus according to claim 7; further comprising means including monochromatic image data memory means for providing monochromatic image data corresponding to said input color image data and means for assigning said n selected colors to said individual image areas on the basis of the equivalence of the luminance of the n selected colors to the luminance of the corresponding monochromatic image area.

10. An image forming apparatus according to claim 1; further comprising pattern defining means for effecting selection and designation of a dot structure defining a pattern;

means controlled by a user of the apparatus for altering said dot structure; and means for generating a pattern definition code according to the altered dot structure;

whereby the dot structure can be adapted to different image resolutions.

11. A method of changing videotex codes consisting of a sequential arrangement of codes including geomoetric codes representing individual image areas as respective geometric drawings and also corresponding characteristic codes representing attributes of said geometric drawings, said method comprising the steps of:

temporarily storing said videotex codes in said sequential arrangement;

analyzing the temporarily stored codes as geometric and characteristic codes, respectively, and entering said geometric codes and pointers identifying corresponding characteristic codes in an order table according to the order of said geometric codes in said sequential arrangement;

entering said characteristic codes in a characteristic code table according to the order of said pointers identifying the characteristic codes; and changing said codes on said tables.

12. The method of claim 11; in which said videotex codes further comprise operand codes; and further comprising the steps of entering data length and operand codes in a data table in an order specified by data pointers, and entering said data pointers in said order table in the order of the respective geometric codes in said sequential arrangement.

* * * * *